US010260520B2

(12) United States Patent
Wang

(10) Patent No.: US 10,260,520 B2
(45) Date of Patent: Apr. 16, 2019

(54) DETACHABLE BLADES FOR A CEILING FAN

(71) Applicant: AIR COOL INDUSTRIAL CO., LTD., Taichung (TW)

(72) Inventor: Cliff Wang, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 387 days.

(21) Appl. No.: 15/175,598

(22) Filed: Jun. 7, 2016

(65) Prior Publication Data

US 2017/0350414 A1 Dec. 7, 2017

(51) Int. Cl.
*F04D 29/34* (2006.01)
*F04D 25/08* (2006.01)

(52) U.S. Cl.
CPC ..... *F04D 29/34* (2013.01); *F04D 25/088* (2013.01)

(58) Field of Classification Search
None
See application file for complete search history.

(56) References Cited

U.S. PATENT DOCUMENTS 6,692,233 B2 * 2/2004 Liang ..... F04D 25/088 403/325
6,726,453 B1 * 4/2004 Hsieh ..... F04D 25/088 416/206
7,008,192 B2 * 3/2006 Hidalgo ..... F04D 25/088 416/206

FOREIGN PATENT DOCUMENTS

WO WO 2015148376 A1 * 10/2015 ..... F04D 25/088

* cited by examiner

*Primary Examiner* — Justin D Seabe
*Assistant Examiner* — Juan G Flores
(74) *Attorney, Agent, or Firm* — Ming Chow; Sinorica, LLC

(57) ABSTRACT

A detachable blade structure has a blade seat, a motor, a cover plate, a spherical cover, a blade, a detachable member and first and second screws. The spherical cover has a cover slot, a cover positioning hole and a cover screw hole. The cover plate has a chamber. The blade is inserted through the cover slot and inserted into the chamber. The blade seat has a first seat lug, a first seat screw hole, a second seat lug and a second seat screw hole. The motor has a motor positioning hole and a motor screw hole. The first seat lug is inserted into the motor positioning hole. The first screw is screwed into the first seat screw hole and the motor screw hole. The second seat lug is inserted into the cover positioning hole. The second screw is screwed into the second seat screw hole and the cover screw hole.

8 Claims, 6 Drawing Sheets

DETACHABLE BLADES FOR A CEILING FAN

BACKGROUND OF THE INVENTION

The present invention relates to a structure of detachable blades for a ceiling fan.

A conventional ceiling fan, in its structure, comprises a motor covered by a outer shield and a frame for the installation of a plurality of blades to be rotated by the motor. At the outer shield, there is hanging rod for the entire ceiling fan to be assembled under the ceiling of a house. It is noted that the hanging rod and the outer shield may become unstable and even damaged due to the material made of the same also the continuous use of rotation driven by the motor. The blades may even fall down causing danger to the user.

Another disadvantage of a conventional ceiling fan is the difficulty in the replacement of the blades while they are used after a period of time. There was an invention for a quick assembly of blades of a ceiling fan disclosed in U.S. Pat. No. 6,171,059B1. FIG. 1 shows the blades assembly of the conventional ceiling fan according to the subject invention. The quick assembly of the blade comprises a blade 1 and a connecting arm 2. The blade 1 has a protrusion 3 having a pair of recesses 4. The connecting arm 2 is connected to the motor 5 and has an insertion slot 6 to receive the protrusion 3 of the blade 1. In the insertion slot 6, there is a slot 7 having an elastic spring 8 contained therein. The elastic spring 8 is wound on a latch 9 which shall be protruded into the recess 4 of the protrusion 3 of the blade 1 to form a firm holding of the blade 1 onto the connecting arm 2. Although this conventional assembly of the blades of a ceiling fan can achieve the goal to quickly assemble the blades of the ceiling fan, it is noted that the blades shall not be detached easily after used for a period of time. Also, the connecting arm 2 may not be strong enough to support a long time rotation of the blades.

SUMMARY OF THE INVENTION

It is therefore the main object of the detachable blades for a ceiling fan according to the present invention is to obviate the disadvantages of the conventional ceiling fans.

Another object of the detachable blades for a ceiling fan according to the present invention is to provide a mechanism so that the blades can be detached from the ceiling fan for replacement.

Still another object of the detachable blades for a ceiling fan according to the present invention is to provide a spherical cover to be used for the amounting of the plurality of blades of the ceiling fan so that the surface of the blades can be flat but to rotate not horizontal with respect to the ground causing a sufficient air flow for the user.

The principle feature of the detachable blades for a ceiling fan according to the present invention is to provide a spherical cover with slots for the blades to be inserted and assembled with a blade seat.

Another feature of the detachable blades for a ceiling fan according to the present invention is to provide a blade comprising a guiding slot to match with a guide on the cover plate so that the blade can be easily and accurately inserted to the blade seat.

Another feature of the detachable blades for a ceiling fan according to the present invention is to provide a cover plate to cover the blades and firmly assembled the same to the blade seat.

An important feature of the detachable blades for a ceiling fan according to the present invention is to provide a detachable member in the cover plate and associated with the blade seat. The detachable member comprises a latch to firmly lock the blade and this latch has a pull handle to be used to detach the blade from the blade seat.

In summary, the detachable blades for a ceiling fan according to the present invention comprises a blade seat for the connecting portion of the blade to be assembled on the same, a spherical cover having a plurality slots for the connecting portion of the blade to be inserted through and assembled to the blade seat, a cover plate to cover the connecting portion of the blade on the blade seat and a detachable member contained in the cover plate to firmly catching the connecting portion of the blade.

BRIEF DESCRIPTION OF THE DRAWINGS

Other objectives, advantages and features of the detachable blades for a ceiling fan according to the present invention will become apparent from the below detailed description of the preferred embodiment with reference to the accompanying drawings, wherein.

DETAILED DESCRIPTION OF THE PREFERRED EMBODIMENT

Figure 1:
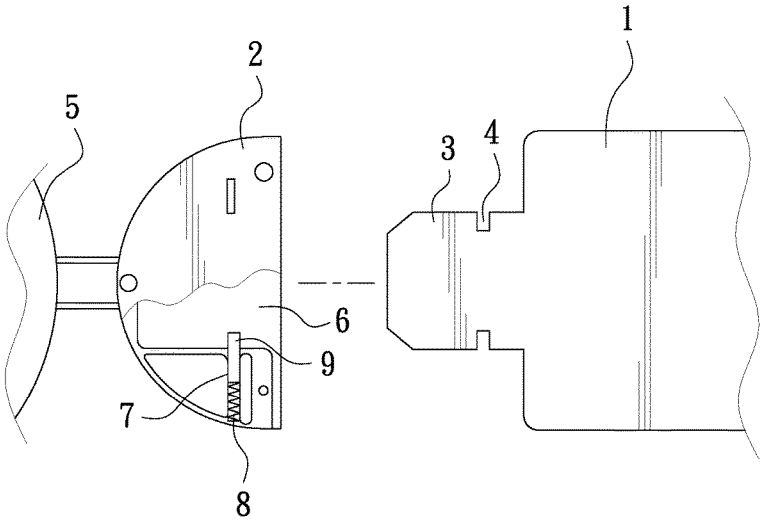
FIG. 1 PRIOR ART
FIG. 1 is an elevation of a conventional quick assembly detachable blade for a ceiling.
Figure 2:
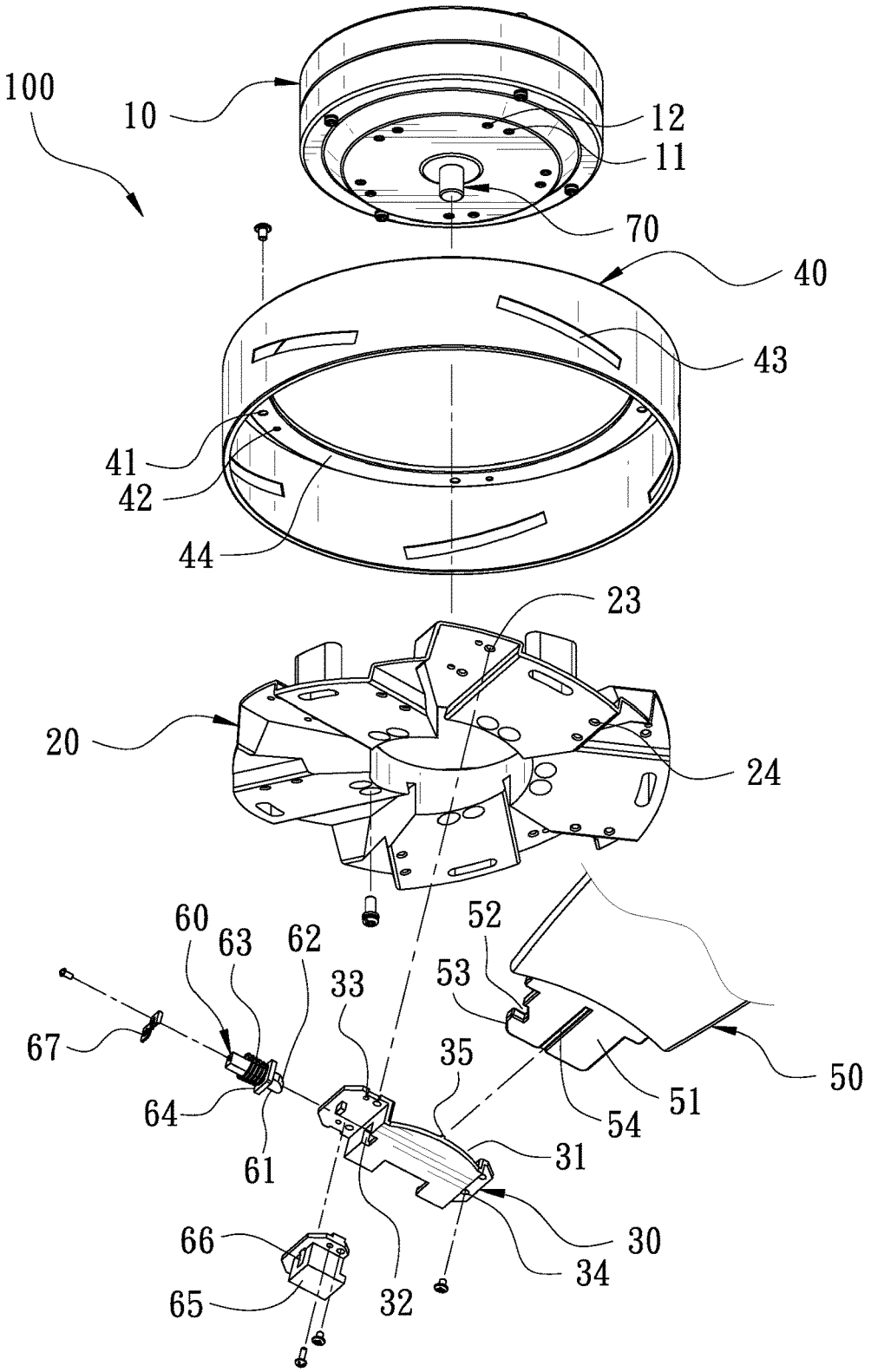
FIG. 2 is an exploded perspective view of an embodiment of a detachable blade for a ceiling fan according to the present invention.

Referring to FIG. 2 which shows an exploded perspective view of an embodiment of a detachable blade for a ceiling fan according to the present invention, the entire ceiling fan structure 100 comprises a motor 10, a blade seat 20, a cover plate 30, a spherical cover 40 and a blade 50.

The motor 10 has a plurality of motor positional holes 11 and a plurality of motor screw holes 12. If an illumination lamp shall be provided below the ceiling fan 100, the lamp can be connected to the electric lamp base 70.

The blade seat 20 has a plurality of first seat lugs 21 and a plurality of first seat screw holes 22 in correspondence to the motor positioning holes 11 and the motor screw holes 12 on the motor 10.

Figure 3:
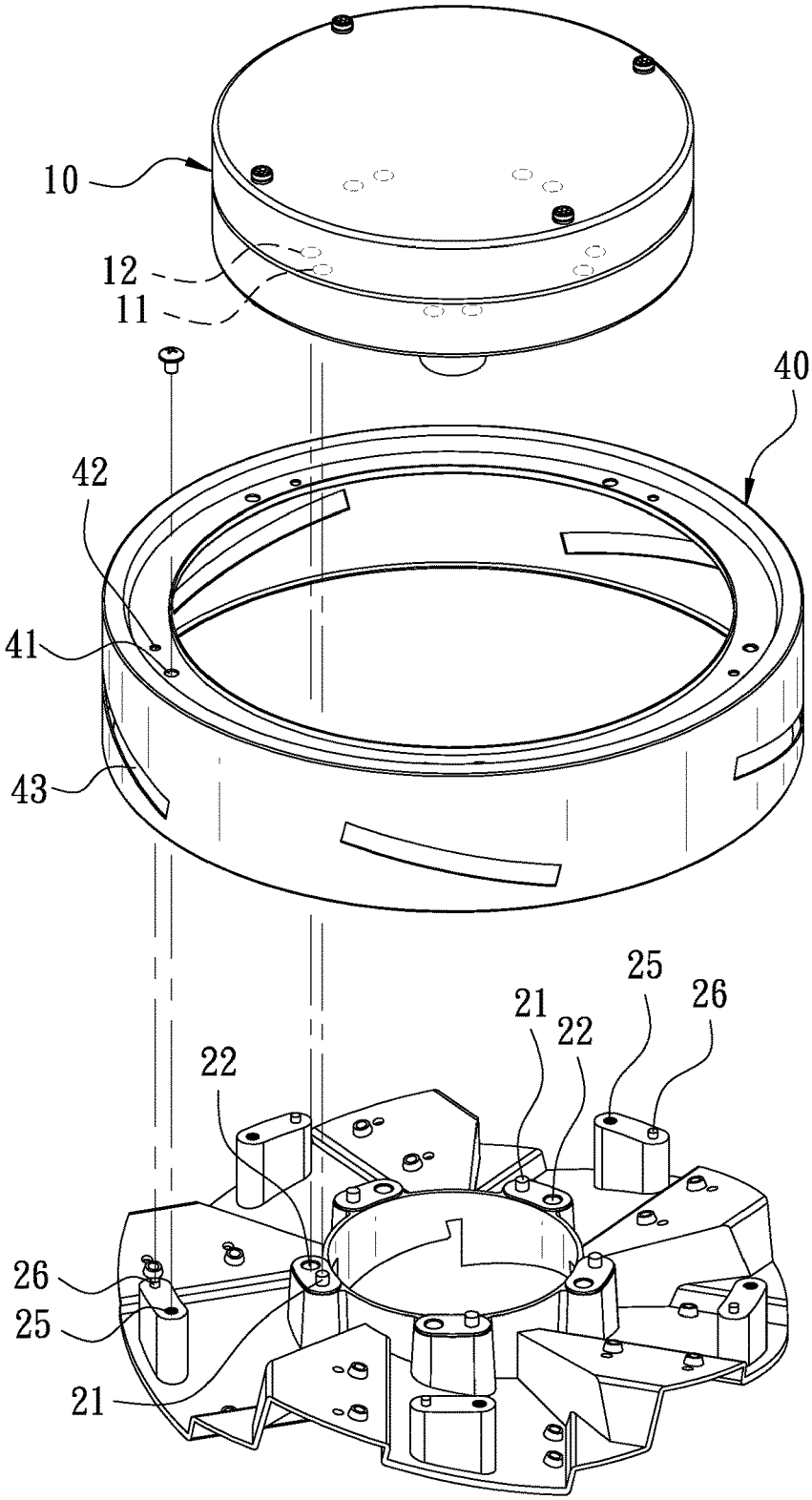
FIG. 3 is an exploded view of the spherical cover and the blade seat of the embodiment of the detachable blade for a ceiling fan according to the present invention in a different view angle showing more detail structure of the same.

Also with reference to FIG. 3 which shows an exploded view of the spherical cover and the blade seat of the embodiment of the detachable blade for a ceiling fan according to the present invention in a different view angle rather than the same shown in FIG. 2, the blade seat 20 further has, on its upper surface, a plurality of screw holes 23, a plurality of screw holes 24, a plurality of second seat screw holes 25 and a plurality of second seat lugs 26. The spherical cover 40 is provided outside of the blade seat 20 and the motor 10. The spherical cover 40 has a cover screw hole 41 and a cover positioning hole 42 corresponding to the second seat screw hole 25 and the second seat lug 26 of the blade seat 20. Particularly refer to FIG. 3, the cover screw hole 41 and cover positioning hole 42 are located on an inner edge 44 of the peripheral cover 40. The spherical cover 40 has a cover slot 43 which is tilt relative to horizontal surface.

Still referring to FIG. 2, a cover plate 30 is assembled under the blade seat 20 forming a chamber 31 which has latch hole 32 communicating with the chamber 31. At two ends of the cover plate 30, there are first through hole 33 and second through hole 34 corresponding to the screw hole 23 and the screw hole 24 of the blade seat 20. There is a guide rail 35 formed on one surface of the cover plate 30.

Still referring to FIG. 2, the blade 50 has a connecting portion 51 corresponding to the chamber 31 of the cover plate 30. The connecting portion 51 is inserted through the cover slot 43 of the spherical cover 40 and stored in the chamber 31. The connecting portion 51 has a latch slot 52 corresponding to the latch hole 32 of the cover plate 30. The connecting portion 51 is formed into a first chamfered edge 53 at a upper portion thereof. This first chamfered edge 53 is at the same side of the latch slot 52. On the connecting portion 51 of the blade 50, it is formed a guide slot 54 which corresponds to the guide rail 35 of the cover plate 30.

Still referring to FIG. 2, the detachable member 60 is contained in a casing 65 assembled to the cover plate 30 with screws. In the casing 65, the detachable member 60 comprises a latch 61, a second chamfered edge 62 corresponding to the first chamfered edge 53 of the blade 50, an elastic spring 63 mounted on the latch 61 which protrudes and passes latch hole 32 of the cover plate 30 into the latch slot 52 of the blade 50. The elastic spring 63 is against a stopper 64. The casing 65 has an opening 66 and the dimension of the stopper 64 is smaller than the same of the latch hole 32 of the cover plate 30 and also the opening 66. The latch 61 has an extended pull handle 67 protruding outward of the opening 66. The stopper 64 may have reciprocating movement in the casing 65 by pulling the pull handle 67 of the latch 61.

Referring to FIGS. 2 and 3, it is readily to know the assembling process e of the entire ceiling fan. The entire ceiling fan structure 100 will be installed first by fixing the motor 10 on the ceiling. Then, the peripheral cover 40 is positioned to align with blade seat 20 by fitting the second seat lug 26 and the cover positioning hole 42. Screws will be used to connect the peripheral cover 40 and blade seat 20 through the second seat screw hole 25 and the cover screw hole 41. Then, the detachable member 60 with its casing 65 is assembled with the cover plate 30 to form the chamber 31 for receiving the connecting portion 51 of the blade 50. With the aid of first seat lug 21 of the blade seat 20 and the motor positioning hole 11 of the motor 10. Screws are used to connect to fix the first seat screw hole 22 of the blade seat 20 and the motor screw hole 22 of the motor 10. Blade 50 will be then inserted into the chamber 31 with the connecting portion 51 passing through the cover slot 43 of the spherical cover 40. The latch 61 of the detachable member 60 will contact and latch slot 52 of the blade 50 to firmly assemble the blade 50 to the blade seat 20.

Figure 4:
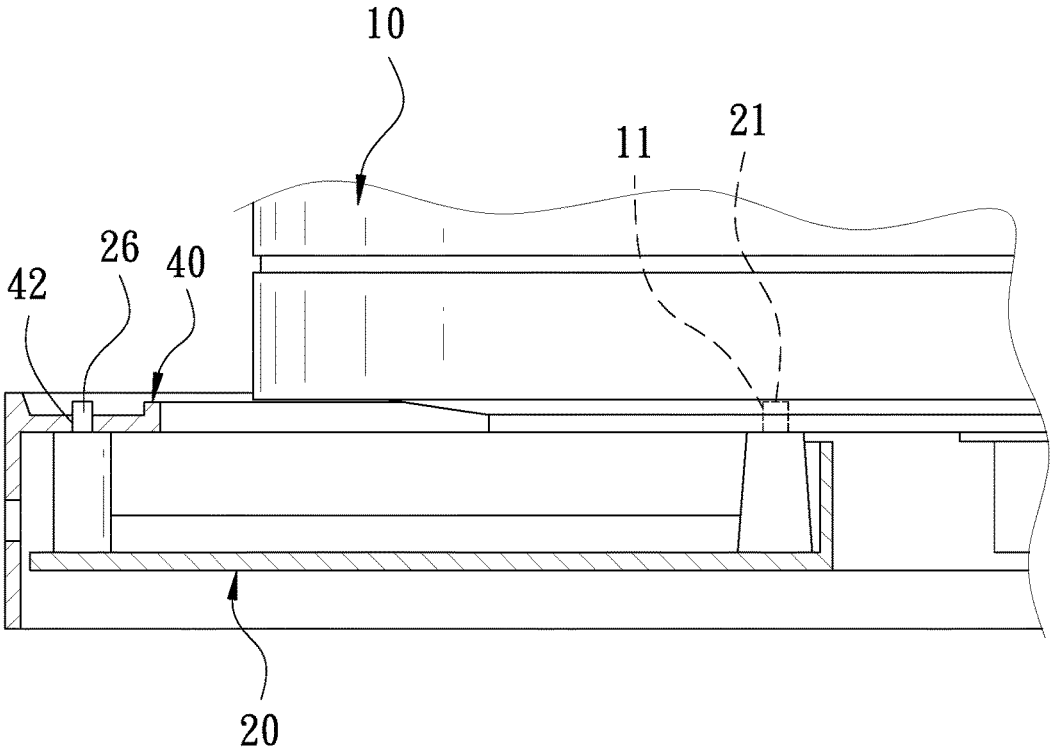
FIG. 4 is an sectional view of the embodiment of the detachable blade for a ceiling fan according to the present invention showing the assembly of the motor, blade seat and the spherical cover.

Referring to FIG. 4 which is an sectional view of the embodiment of the detachable blade for a ceiling fan according to the present invention showing the assembly of the motor, blade seat and the spherical cover, the peripheral cover 40 is positioned to align with the blade seat 20 by fitting the second seat lug 26 and the cover positioning hole 42. With the aid of the first seat lug 21 of the blade seat 20 and the motor positioning hole 11 of the motor 10, the entire assembling procedure can be very much simplified.

Figure 5:
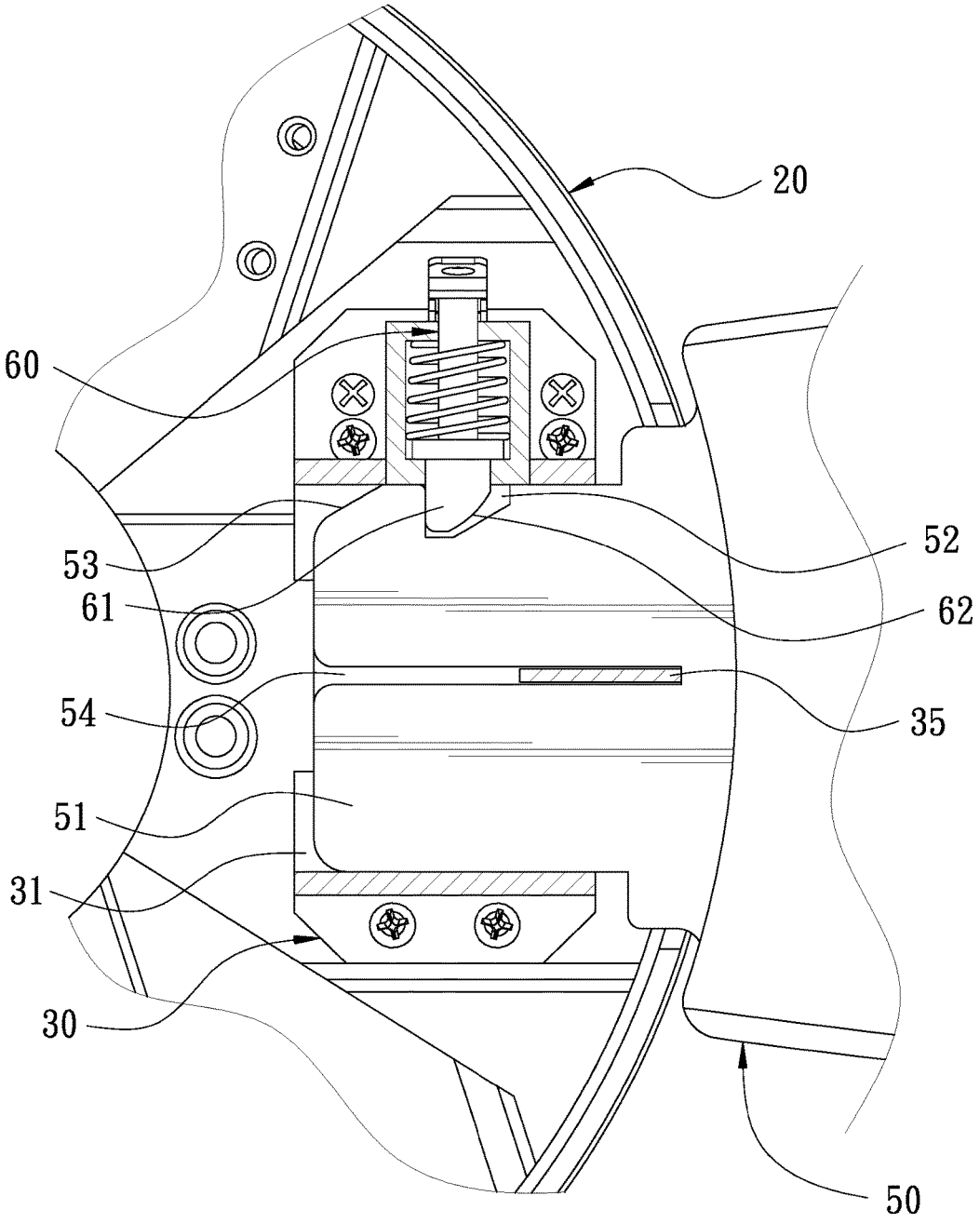
FIG. 5 is a sectional view of a portion of the embodiment of the detachable blade for a ceiling fan according to the present invention showing the connecting portion of the blade being assembled in the bade seat and covered with the cover plate.

Referring to FIG. 5 which shows a sectional view of a portion of the embodiment of the detachable blade for a ceiling fan according to the present invention, the connecting portion 51 of the blade 50 is assembled in the bade seat 20 and covered with the cover plate 30. With the guide rail 35 of the cover plate 30 and the guiding slot 52 of the blade 50, the connecting portion 51 of the blade 50 may be smoothly inserted into the chamber 31. The first chamfered edge 53 of the connecting portion 51 will pass over the second chamfered edge 62 of the detachable member 60. The latch 61 will be retracted to press the elastic spring 63 and then pushed back by the same to stay into the latch slot 52 of the blade 50.

Figure 6:
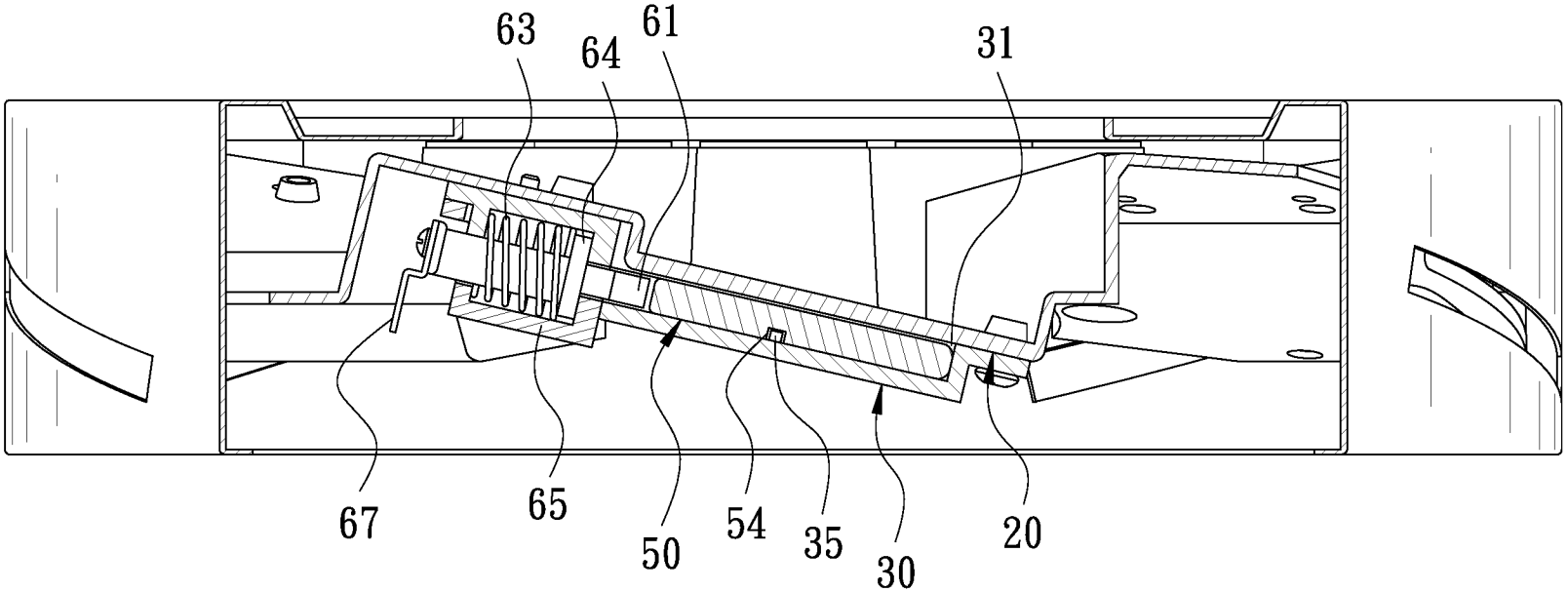
FIG. 6 is a sectional view of a portion of the embodiment of the detachable blade for a ceiling fan according to the present invention showing the connection portion of the blade is caught in the detachable member in the spherical cover.

Referring to FIG. 6 which shows a sectional view of a portion of the embodiment of the detachable blade for a ceiling fan according to the present invention showing the connection portion 51 of the blade 50 is caught in the detachable member 60 in the spherical cover 40, the blade 50 is firmly hold in the chamber 31 of the cover plate 30. The blade 50 is also supported by the peripheral cover 40 because the connecting portion 51 of the blade 50 is actually supported by the peripheral cover 40 to rotate along with the entire assembly.

Also from FIGS. 2 and 3, it is readily to see that the cover slot 43 of the spherical cover 40 being tilt shaped according to the present invention. Therefore, the ceiling fan blades can rotate not horizontal with respect to the ground causing a sufficient air flow for the user even with the shape of the surface of the blades being flat.

If one of the blades has been damaged and in need of a replacement, it is readily to see from the above description, user may pull handle 67 of the latch 61 to cause the same depart from the latch slot 52 of the blade 50. The entire blade can be detached from the ceiling fan.

Although the detachable blade for a ceiling fan according to the present invention has been described in a preferred embodiment hereinabove, it is to be noted that other changes, modifications and improvements can still be made without departing from the spirit of the invention and shall be fallen in the protection scope as specified in the appended claims.

What is claimed is:

1. A detachable blade structure for a ceiling fan comprising:

a blade seat;
a motor;
a cover plate;
a spherical cover;
a blade;
a detachable member;
a first screw;
a second screw;
the blade comprising a connecting portion;
the connecting portion being assembled on the blade seat;
the spherical cover comprising a cover slot, an inner edge, a cover positioning hole and a cover screw hole;
the connecting portion being inserted through the cover slot;
the cover plate being connected to the blade seat;
the cover plate comprising a chamber;

the chamber being adjacently located to the blade seat;

the connecting portion being inserted into the chamber;

the detachable member being assembled with the cover plate;

the detachable member being detachably engaged with the connecting portion;

the blade seat comprising a first seat lug, a first seat screw hole, a second seat lug and a second seat screw hole;

the motor comprising a motor positioning hole and a motor screw hole;

the first seat lug being inserted into the motor positioning hole;

the first seat screw hole and the motor screw hole being corresponding to each other;

the first screw being screwed into the first seat screw hole and the motor screw hole;

the cover positioning hole and the cover screw hole being formed on the inner edge;

the second seat lug being inserted into the cover positioning hole;

the second seat screw hole and the cover screw hole being corresponding to each other; and the second screw being screwed into the second seat screw hole and the cover screw hole.

2. The detachable blade structure according to claim 1, wherein the connecting portion comprises a latch slot, the detachable member comprises a latch, and the latch detachably protrudes into the latch slot.

3. The detachable blade structure according to claim 2, wherein the connecting portion comprises a first chamfered edge, and the first chamfered edge being adjacently located to the latch slot.

4. The detachable blade structure according to claim 3, wherein the latch comprises a second chamfered edge, and the second chamfered edge corresponds to the first chamfered edge.

5. The detachable blade structure according to claim 4, wherein the detachable member comprises an elastic spring, the elastic spring is mounted on the latch, the cover plate comprises a latch hole, the latch hole is communicated with the chamber, and the latch detachably passes through the latch hole.

6. The detachable blade structure according to claim 2, wherein the detachable member comprises an opening, the latch comprises an extended pull handle, and the extended pull handle protrudes outward of the opening.

7. The detachable blade structure according to claim 1, wherein the connecting portion comprises a guiding slot, the cover plate comprises a guide rail, and the guide rail and the guiding slot are engaged with each other when the connecting portion is inserted through the cover slot and inserted into the chamber.

8. The detachable blade structure according to claim 1, wherein the cover slot being tilted.

* * * * *